US012392067B2

(12) United States Patent
Gupta

(10) Patent No.: US 12,392,067 B2
(45) Date of Patent: Aug. 19, 2025

(54) FLAT HEAD PIN

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 334 days.

(21) Appl. No.: 17/738,796

(22) Filed: May 6, 2022

(65) Prior Publication Data

US 2023/0029886 A1 Feb. 2, 2023

Related U.S. Application Data

(60) Provisional application No. 63/226,215, filed on Jul. 28, 2021.

(51) Int. Cl.
*D05B 91/06* (2006.01)

(52) U.S. Cl.
CPC ..... *D05B 91/06* (2013.01)

(58) Field of Classification Search
CPC ..... D05B 91/06; F16B 35/06; F16B 21/084; F16B 15/02; Y10T 24/4696; Y10S 411/923; A41H 31/00; A44B 9/04; B43M 15/00
USPC ..... 81/489, 490, 491, 492; 16/110.1, 405, 16/413, 421, 422, 426, 429, 430, 436, 16/440
See application file for complete search history.

(56) References Cited

U.S. PATENT DOCUMENTS 2,443,540 A * 6/1948 Lewis ..... D04B 17/04 D15/78
3,205,757 A * 9/1965 Kuennen ..... F16B 15/02 24/711.4
6,406,241 B1 * 6/2002 Lorincz ..... F16B 15/08 411/461
6,520,704 B1 * 2/2003 Vidmar ..... F16B 35/06 403/279
8,317,445 B2 * 11/2012 Reeder ..... B43M 15/00 411/923
D860,633 S * 9/2019 Schaumann ..... D3/28

FOREIGN PATENT DOCUMENTS

CN 202806108 U * 3/2013
JP 2002220461 A * 8/2002

OTHER PUBLICATIONS

Unpublished U.S. Appl. No. 29/768,007, filed Jan. 27, 2021, entitled "Magic Pin With Ultra Grip" of Nikhil Gupta.
Unpublished PCT/US2022/011470, filed Jan. 6, 2022, entitled entitled "Magic Pin With Ultra Grip" of Nikhil Gupta.

* cited by examiner

*Primary Examiner* — Brian D Keller
*Assistant Examiner* — John C Merino
(74) *Attorney, Agent, or Firm* — Dunlap Bennett & Ludwig, PLLC; Anna L. Kinney

(57) ABSTRACT

A flat-head pin includes: (a) a pin shaft with a pin point; (b) a flat pin head affixed to an end of the pin shaft distal to the pin point; wherein the flat pin head is characterized by a cuboid shape, preferably a tapered cuboid shape with a plurality of transverse gripping ribs spaced a distance, s, from each other. The flat pin head is characterized by a tapered cuboid shape with a plurality of transverse gripping ribs spaced a distance, s, preferably wherein the distance s is relatively large and there are relatively few gripping ribs, such as 3-5 transverse gripping ribs.

18 Claims, 4 Drawing Sheets

FLAT HEAD PIN

CLAIM FOR PRIORITY

This Application is based on U.S. Provisional Application No. 63/226,215 of the same title filed Jul. 28, 2021, the priority of which is hereby claimed and the disclosure of which is incorporated herein by reference.

TECHNICAL FIELD

The present invention relates to pins used in connection with sewing; and in particular, to pins with an easy-grasp head to facilitate their use.

BACKGROUND

Pins with improved heads for sewing applications are known in the art. For example, there is disclosed in U.S. Design Patent No. D860,633 a pin with an elongate tapered ribbed head. Further improvements to the tapered ribbed head are seen in U.S. Design Pat. Application No. 29/768,007 and International Patent Application No. PCT/US2022/011470. Flat head pins are popular in the marketplace, but prior designs were found inferior to the present invention and may have been perceived as being hard to pick up, hard to grip, manipulate or control, particularly when trying to penetrate tougher materials like denim.

SUMMARY OF INVENTION

There is provided in accordance with the invention a flat-head pin comprising:

(a) a pin shaft with a pin point, (b) a flat pin head affixed to an end of the pin shaft distal to the pin point;

wherein the flat pin head is characterized by a cuboid shape, preferably a tapered cuboid shape with a plurality of transverse gripping ribs spaced a distance, s, from each other.

It has been found in accordance with the present invention that a flat head pin characterized by a tapered cuboid shape with a plurality of transverse gripping ribs spaced a distance, s, from each other was vastly preferred by seamstresses over other flat-head pin designs, especially when distance s is relatively large and there are relatively few gripping ribs, 3-5 transverse gripping ribs, for example.

Still further features, advantages and further aspects will become apparent from the discussion which follows and the accompanying drawings.

BRIEF DESCRIPTION OF DRAWINGS

The invention is described in detail below in connection with the accompanying drawings wherein like numerals designate similar parts and wherein.

DETAILED DESCRIPTION

Figure 1:
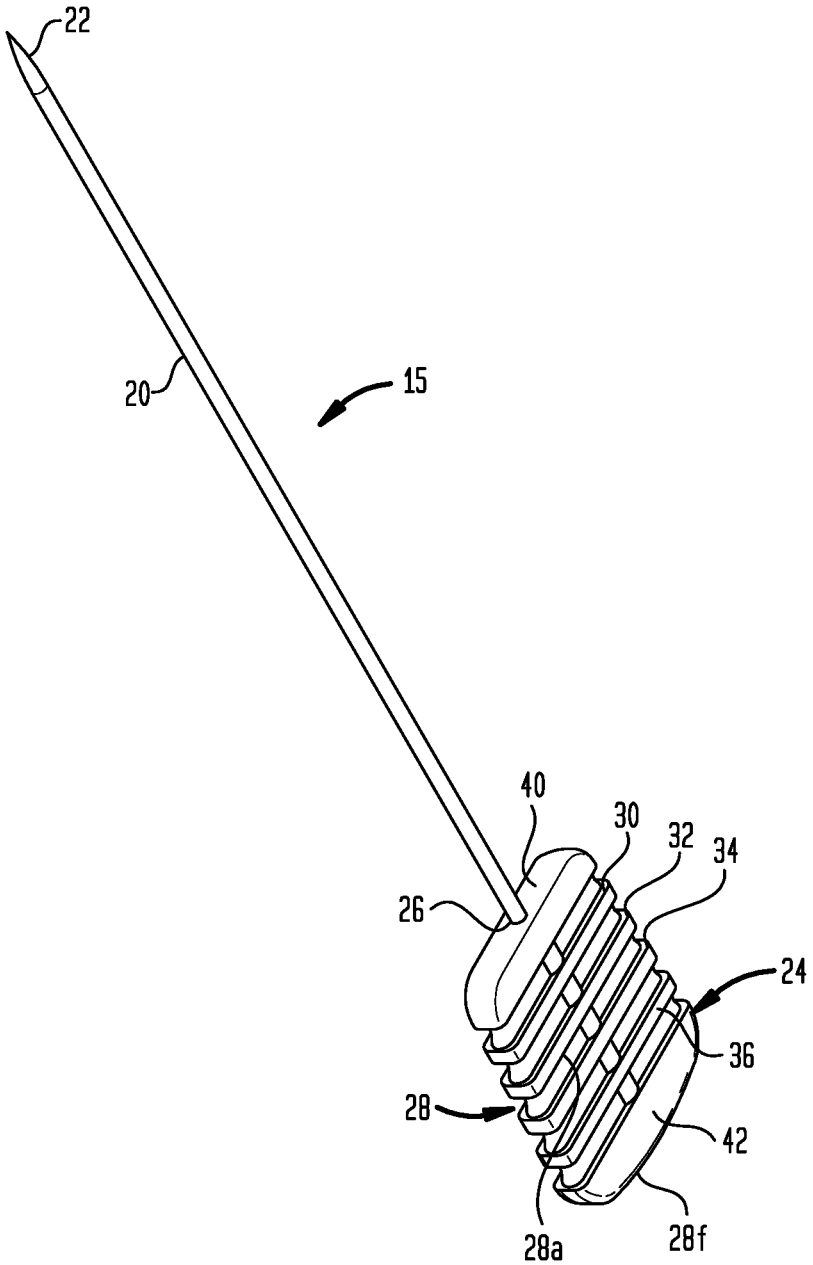
FIG. 1 is a perspective view of a flat-head pin head of the invention characterized by a tapered cuboid shape with a plurality of transverse gripping ribs spaced a distance, s, from each other.
Figure 2:
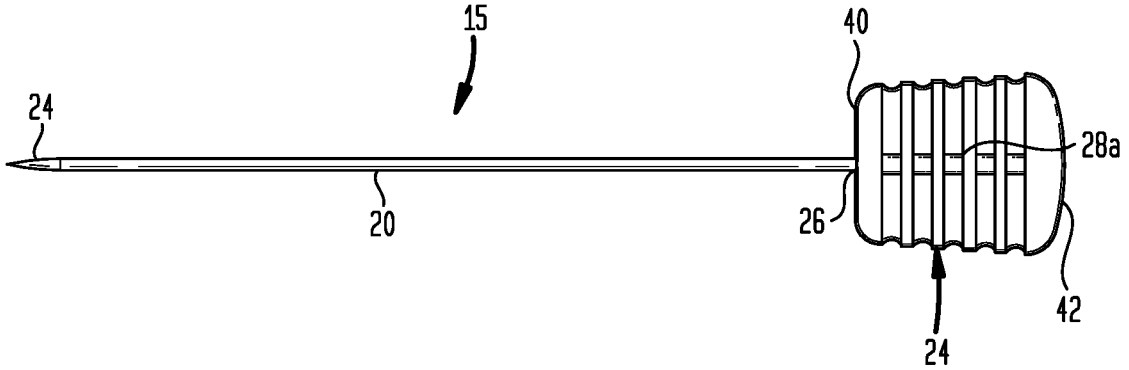
FIG. 2 is a top plan view of the flat-head pin of FIG. 1.
Figure 3:
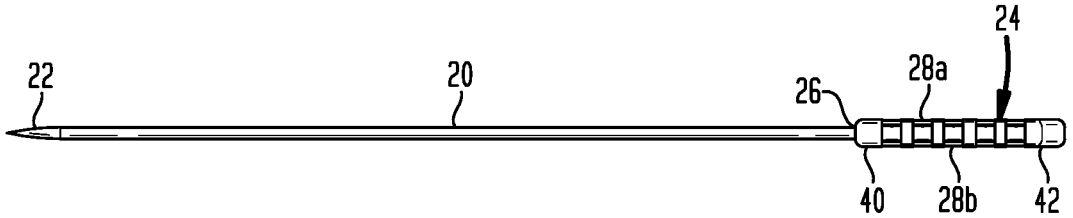
FIG. 3 is a side view in elevation of the flat-head pin of FIG. 1.

Referring to the drawings, there is illustrated a flat-head pin 15 including a pin shaft 20 with a pin point 22, a flat pin head 24 affixed to an end 26 of the pin shaft distal to pin point 22. The flat pin head is characterized by a tapered cuboid shape 28 with upper and lower surfaces 28*a*, 28*b*, lateral surfaces 28*c*, 28*d*, inner surface 28*e* and outer surface 28*f* and a plurality of transverse gripping ribs 30, 32, 34, 36 spaced a distance, s, from each other. The gripping ribs are transverse in that they are substantially perpendicular to pin shaft 20.

The distance, s, is typically from 0.7 mm to 1.25 mm; suitably about 1 mm in a preferred embodiment. Flat pin head 24 has a thickness, t, of from 1 mm to 1.6 mm; suitably about 1.3 mm in a preferred embodiment as well as a length, L, of from 7 mm to 13 mm; suitably around 10 mm in a preferred embodiment.

Transverse gripping ribs 30, 32, 34, 36 have a width, w, of from 0.5 mm to 1.0 mm; suitably about 0.75 mm in a preferred embodiment. The transverse gripping ribs project laterally as shown from flat pin head lateral surfaces 28*c*, 28*d* a distance, d, of from 0.2 mm to 0.8 mm from the sides of the pin head and somewhat less from the upper and lower surfaces of the flat pin head. Distance d may be about 0.5 mm and generally from 1.0 to 2 times the distance the ribs project from the upper and lower surfaces of the pin head.

It is appreciated from the drawings that flat pin head 24 tapers from an inner characteristic width, iw, adjacent the pin shaft to a longer outer characteristic width, ow, wherein the widths refer to the distance across the upper and lower surfaces perpendicular to shaft 20. Inner characteristic width of the flat pin head iw, is from 6 mm to 9 mm; suitably about 7-8 mm, while outer characteristic width of the flat pin head, ow, is from 7 mm to 10 mm with the proviso that ow is greater than iw. A taper thus occurs over a length L of the flat pin head.

Flat pin head 24 has an inner terminal portion 40 adjacent the pin shaft and an outer terminal portion 42 distal to the pin shaft. Widths 44, 46 (transverse widths along upper and lower surfaces 28*a*, 28*b*) of the inner and outer terminal portions are greater than the width, w, of the gripping ribs.

Outer terminal portion 42 of the flat pin head has an arcuate outer edge.

Figure 4:
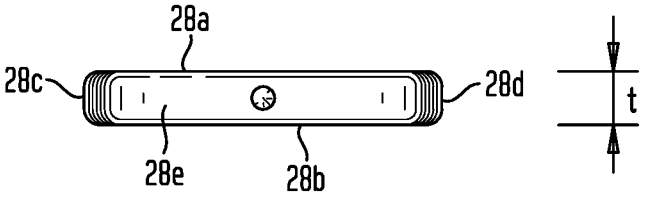
FIG. 4 is an end view in elevation of the flat-head pin of FIG. 1.
Figure 5:
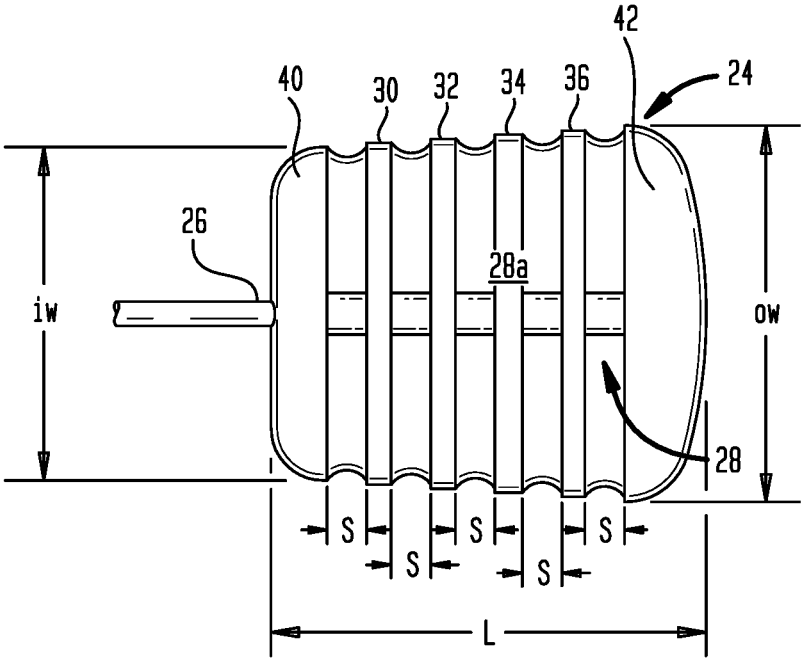
FIG. 5 is an enlarged top plan view of the pin flat head with a plurality of transverse gripping ribs spaced a distance, s, from each other of FIGS. 1 through 4.
Figure 6:
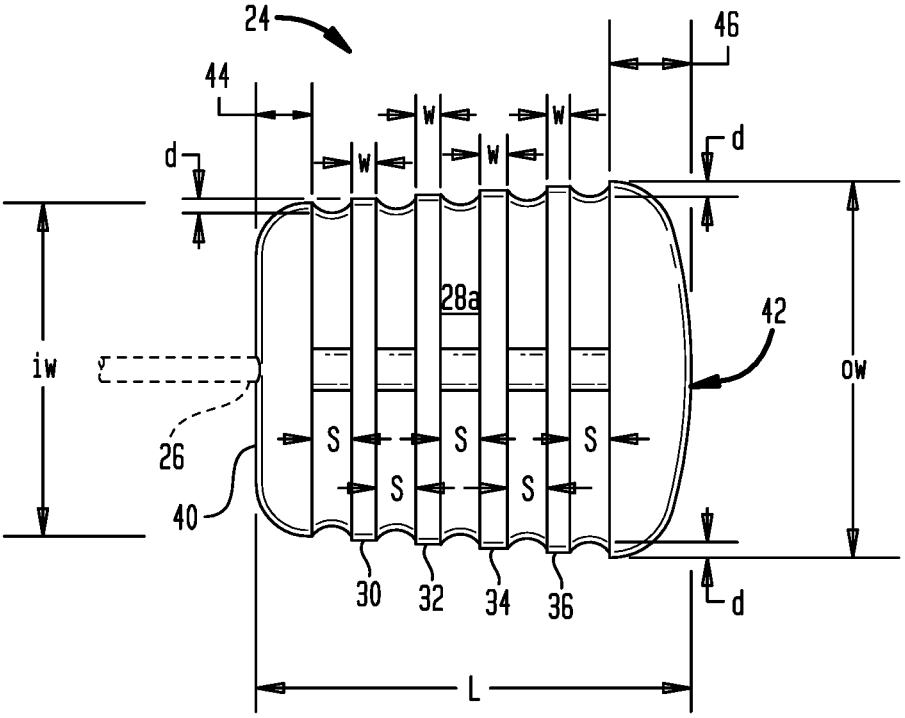
FIG. 6 is a schematic diagram illustrating rib profiles and characteristic dimensions of the flat head pin of FIGS. 1 through 6.

Typically, the flat pin head has from 3-5 transverse gripping ribs, suitably 4 transverse gripping ribs. Note that that pin shaft 20 is centrally affixed to inner surface 28*e* of flat pin head 24, that is located at the midpoints of the thickness and width of flat pin head 24 head as shown in FIG. 4.

Pin head 24 is preferably made of a thermoplastic polymer material. The thermoplastic polymer material is preferably chosen from heat-resistant thermoplastic polymers with a melting temperature greater than 200° C. Polypropylene and polyethylene, which have lower melting points, may not be sufficiently heat resistant to avoid damage from a hot iron which is a requirement in many sewing operations so that a garment is not damaged by molten resin. Suitable polymers include nylon polymers such as nylon 6 and nylon 6,6. The pinhead may be attached to the pin shaft by melt-bonding with or without an adhesive and/or surface roughening. For example, the pin head may be injection molded onto the shaft if so desired.

Seamstress Evaluation

Figure 7:
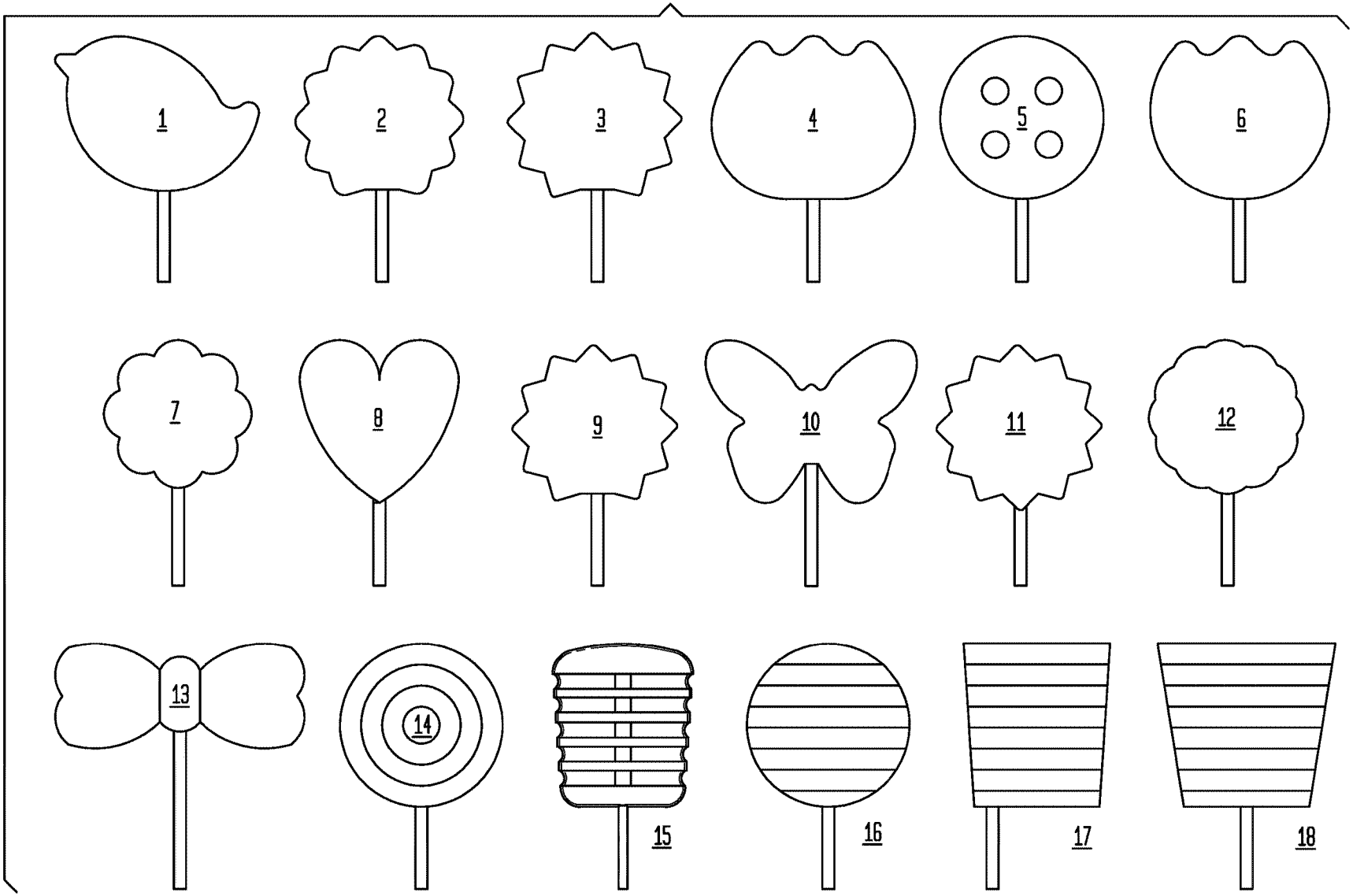
FIG. 7 is a schematic diagram illustrating 18 pin designs evaluated by seamstress panelists.

The inventor provided 13 prior art flat-head designs (pins numbered 1-13) and five new tentative designs (pins numbered 14-18) to be evaluated for seamstress preference. The designs were evaluated by eight (8) seamstress panelists on a scale of 1-10 for utility and ease of use. The 8 seamstress were shown the pins independently—so as not to have any group/peer influence (in a group testing scenario, sometimes evaluators start to emulate the leader even if they have a different opinion on an item). All of the panelists selected the same pin as best, number 15 in FIG. 7, giving it the highest rating of all the pins. The response was surprising, the panelists were all very impressed by the presently presented design of pin 15 (having the features and dimensions noted above) to the exclusion of the other flat-head pin designs. And that is what makes the selection of #15 so fascinating—neither seamstress knew what the others had selected as it was tested independently—they all picked #15 in an independent setting. The results were also surprising since pin 18 was substantially identical to pin 15, except pin 18 had many more gripping ribs, spaced a distance of slightly less than 0.5 mm, whereas the rib spacing in pin 15 which was about 1 mm.

What is claimed is:

1. A flat-head pin comprising:

(a) a pin shaft with a pin point; and (b) a flat pin head affixed to an end of the pin shaft distal to the pin point;

wherein the flat pin head is characterized by a tapered cuboid shape with a plurality of transverse gripping ribs spaced a distance, s, from each other and a plurality of semicylindrical segments having a common diameter interposed between the transverse gripping ribs, wherein the semicylindrical segments are coaxial with a longitudinal axis of the pin shaft;

wherein the flat pin head tapers from an inner characteristic width, iw, adjacent the pin shaft to a longer outer characteristic width, ow, such that the taper occurs over a length L of the flat pin head; and wherein the distance, s, is from 0.7 mm to 1.25 mm.

2. The flat-head pin according to claim 1, wherein the flat pin head has a thickness, t, of from 1 mm to 1.6 mm.

3. The flat-head pin according to claim 1, wherein the flat pin head has length, L, of from 7 mm to 13 mm.

4. The flat-head pin according to claim 1, wherein the transverse gripping ribs have a width, w, of from 0.5 mm to 1.0 mm.

5. The flat-head pin according to claim 1, wherein the transverse gripping ribs project laterally from the flat head pin a distance, d, of from 0.2 mm to 0.8 mm.

6. The flat-head pin according to claim 1, wherein the inner characteristic width of the flat pin head, iw, is from 6 mm to 9 mm.

7. The flat-head pin according to claim 1, wherein the outer characteristic width of the flat pin head, ow, is from 7 mm to 10 mm with the proviso that ow is greater than iw.

8. The flat-head pin according to claim 1, wherein the flat pin head has an inner terminal portion adjacent the pin shaft and an outer terminal portion distal to the pin shaft and wherein the width of the inner and outer terminal portions are greater than the width, w, of the gripping ribs.

9. The flat-head pin according to claim 8, wherein the outer terminal portion of the flat pin head has an arcuate outer edge.

10. The flat-head pin according to claim 1, wherein the flat pin head is formed of a thermoplastic material.

11. The flat-head pin according to claim 10, wherein the thermoplastic material is a heat-resistant thermoplastic material with a melting temperature greater than 200° C.

12. The flat-head pin according to claim 11, wherein the heat-resistant thermoplastic material is a nylon polymer.

13. The flat-head pin according to claim 12, wherein the nylon polymer is nylon 6.

14. The flat-head pin according to claim 12, wherein the nylon polymer is nylon 6,6.

15. The flat-head pin according to claim 1, wherein the flat pin head has from 3-5 transverse gripping ribs.

16. The flat-head pin according to claim 15, wherein the flat pin head has 4 transverse gripping ribs.

17. The flat-head pin according to claim 1, wherein the pin shaft is centrally affixed to an inner surface of the flat pin head.

18. A flat-head pin comprising:

(a) a pin shaft with a pin point; and (b) a flat pin head affixed to an end of the pin shaft distal to the pin point;

wherein the flat pin head is characterized by a tapered cuboid shape with a plurality of transverse gripping ribs spaced a distance, s, from each other and a plurality of semicylindrical segments having a common diameter interposed between the transverse gripping ribs, wherein the semicylindrical segments are coaxial with a longitudinal axis of the pin shaft;

wherein the flat pin head tapers from an inner characteristic width, iw, adjacent the pin shaft to a longer outer characteristic width, ow, such that the taper occurs over a length L of the flat pin head;

wherein the distance, s, is from 0.7 mm to 1.25 mm;

wherein the flat pin head has a thickness, t, of from 1 mm to 1.6 mm;

wherein the length, L, is from 7 mm to 13 mm; and wherein the transverse gripping ribs have a width, w, of 0.5 mm to 1.0 mm.

* * * * *